United States Patent [19]

Nussdorf et al.

[11] 4,373,570

[45] Feb. 15, 1983

[54] PORTABLE FABRIC DISPLAY BOOTH ASSEMBLY

[76] Inventors: Jeffrey M. Nussdorf, 1612 Worcester Rd., Framingham, Mass. 01701; John C. McMillan, 24 St. John Pl., Westport, Conn. 06880

[21] Appl. No.: 173,954

[22] Filed: Jul. 31, 1980

[51] Int. Cl.[3] ..... A47G 5/00

[52] U.S. Cl. ..... 160/352; 160/351; 160/385; 160/DIG. 18

[58] Field of Search ..... 160/352, 351, 135, DIG. 18, 160/385; 40/606, 610; 273/26 A, 181 F; 135/5 R

[56] References Cited

U.S. PATENT DOCUMENTS

| | | | |
|---|---|---|---|
| 1,181,473 | 5/1916 | Nasser et al. | 160/352 X |
| 1,807,478 | 5/1931 | Isaacson | 160/385 |
| 1,925,815 | 9/1933 | Nicolson | 160/245 X |
| 1,928,366 | 9/1933 | Buckingham | 160/DIG. 18 |
| 2,168,913 | 8/1939 | Middleton | 160/DIG. 18 |
| 2,426,133 | 8/1947 | Willis | 160/DIG. 18 |
| 2,887,983 | 5/1959 | Budd | 40/610 X |
| 3,004,592 | 10/1961 | Norton | 160/DIG. 18 |
| 3,323,530 | 6/1967 | Smith | 135/4 R X |
| 3,571,999 | 3/1971 | Downing | 160/351 X |

FOREIGN PATENT DOCUMENTS

| | | | |
|---|---|---|---|
| 261102 | 6/1963 | Australia | 135/5 R |
| 481454 | 11/1937 | United Kingdom | 160/351 |

*Primary Examiner*—Rodney H. Bonck
*Attorney, Agent, or Firm*—Alfred E. Miller

[57] ABSTRACT

A portable fabric display booth assembly for placement on standards and posts delineating booths for exhibition purposes. Zippered sleeves are placed over the standards and posts and fabric sheet material having edges provided with complementary zippers are zipped to each adjacent sleeve, respectively in order to at least partially enclose an area for display.

5 Claims, 7 Drawing Figures

PORTABLE FABRIC DISPLAY BOOTH ASSEMBLY

Basic standards and rails are supplied by exhibition hall operators who rent exhibition space to various companies for display of their goods. Since, in many cases, it is necessary to hire artisans, either supplied by the exhibition hall management, or outside contractors to both install and disassemble exhibition booths, this procedure becomes expensive, as well as time consuming. A new system has been devised in which one person, using no tools, can install a fabric booth or background unit on any basic standard and rail system supplied by exhibition halls to form booth enclosures and upon which displays and other accessories can be affixed.

It is a feature of the present invention to provide a portable fabric booth assembly that is extremely light in weight and can be set up by one person using no tools.

It is a further feature of the present invention to complement the basic fabric booth assembly with selective options, such as lighting, headers, product mounting systems, and varied configurations permitting expanded display areas with display shelves and graphics. The options are specifically designed to be weight-efficient, and can be customized for each customer's specific requirements.

The invention features zippered sleeves which fit over the upright standards, and additionally may be inserted over the side posts of a three-sided exhibition booth. The sheet fabric is held taut by sleeves constituted of fabric having good stretching qualities together with zipper closure devices.

A further feature of the present invention is the utilization of an expandable locking pole, extending horizontally, and adapted to be held in pockets in each of the sleeves over the upright standards. This arrangement permits the main back sheet to be held in a taut position.

It is a further feature of the present invention to make the fabric display assembly of various sizes and configurations, depending upon the customer's requirements. All of the display assemblies are completely portable and can be handled by one person, both in the installation and in the disassembly.

In order that the invention will be more clearly understood, it will now be disclosed in greater detail with reference to the accompanying drawings, in which.

Figure 1:
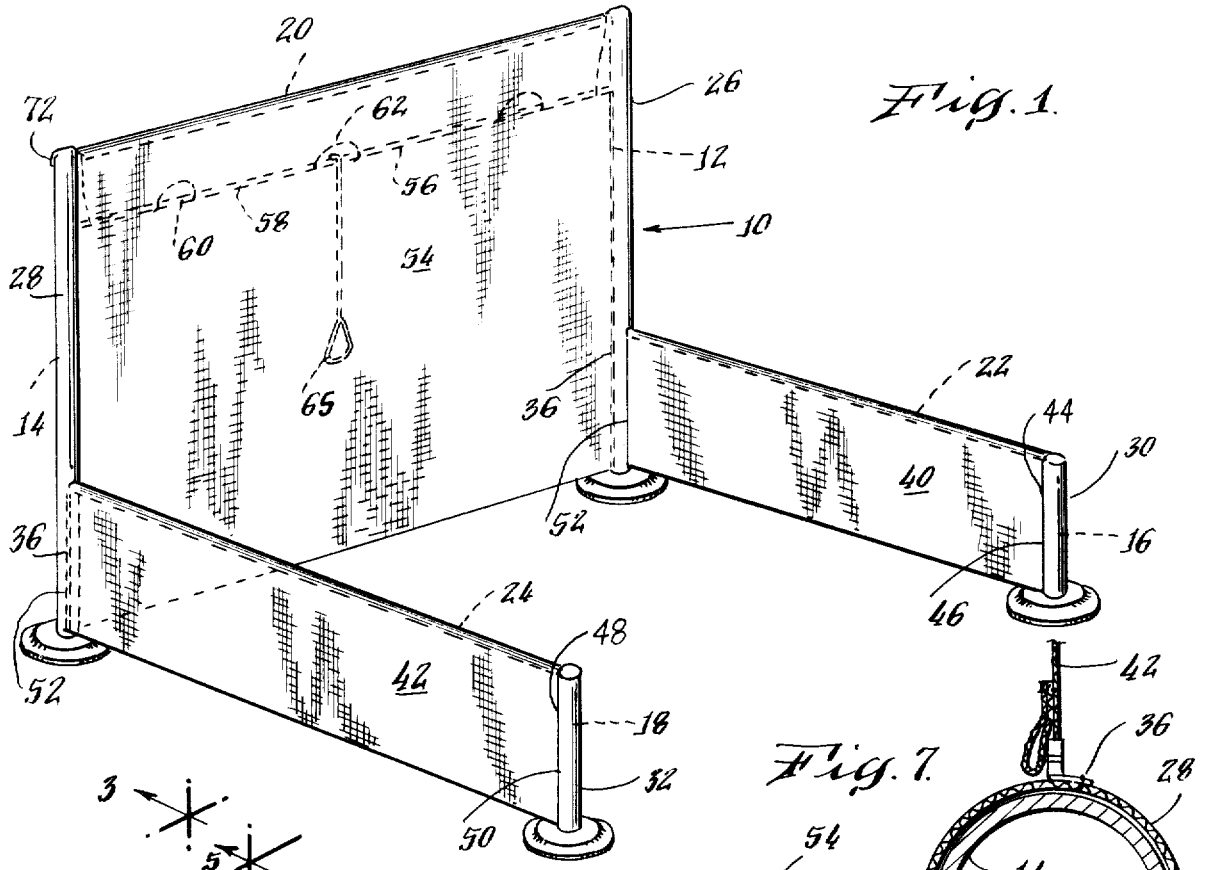
FIG. 1 is a perspective view of the fabric display booth assembly in accordance with the teachings of the present invention.

Referring to FIG. 1, the fabric display booth assembly referred to generally by the numeral 10 is shown as three-sided, however it should be understood that the configuration may be in the alternative, a single fabric backdrop, or a series of interconnected joining booths, or a back or back booths, as well as other configurations.

In exhibition halls vertical standards 12 and 14 are provided by the management, as well as side posts 16 and 18. In the past it was common to merely drape material over the rails 20, 22 and 24 of the standard exhibition booth or support rigid back board thereagainst. However, this previous arrangement was unsatisfactory inasmuch as it was unprofessional looking, and also, in some cases, did not provide a rigid structure for customizing the exhibits so that lighting, shelving, headers, and other types of weighty objects could be suspended from the rear and side walls thereof. The present assembly utilizes a pair of slidable sleeves 26 and 28 which are inserted over the upright vertical standards 12 and 14, as well as short sleeves 30 and 32 which are inserted over the wide posts 16 and 18, respectively. The construction of the sleeves is typified by the enlarged view of sleeve 28 shown in FIG. 7.

Figure 7:
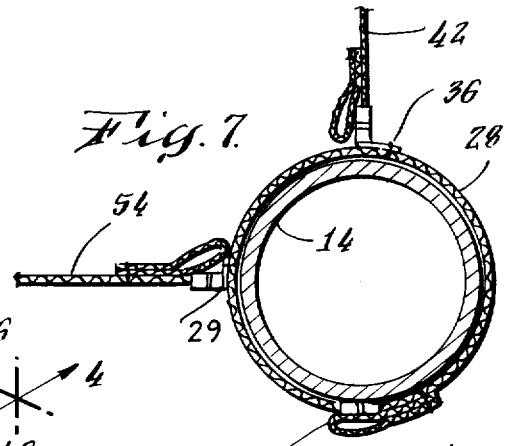
FIG. 7 is an enlarged view taken along the lines 7—7 of FIG. 2.

The sleeve shown in FIG. 7 is provided with longitudinal zippers 34, 36 and 29 which are spaced approximately 90° apart. The zipper 34 is the main zipper for holding the entire sleeve 28 on the upright standard 14, while the zipper 36 is a short closure device or a half zipper extending less than half way up the front sleeve 14. The closure member for zipper 36 will be described hereinafter. The description relating to the sleeve 28 for upright standard 14 applies equally as well to the sleeve 26 for upright standard 12.

Figure 2:
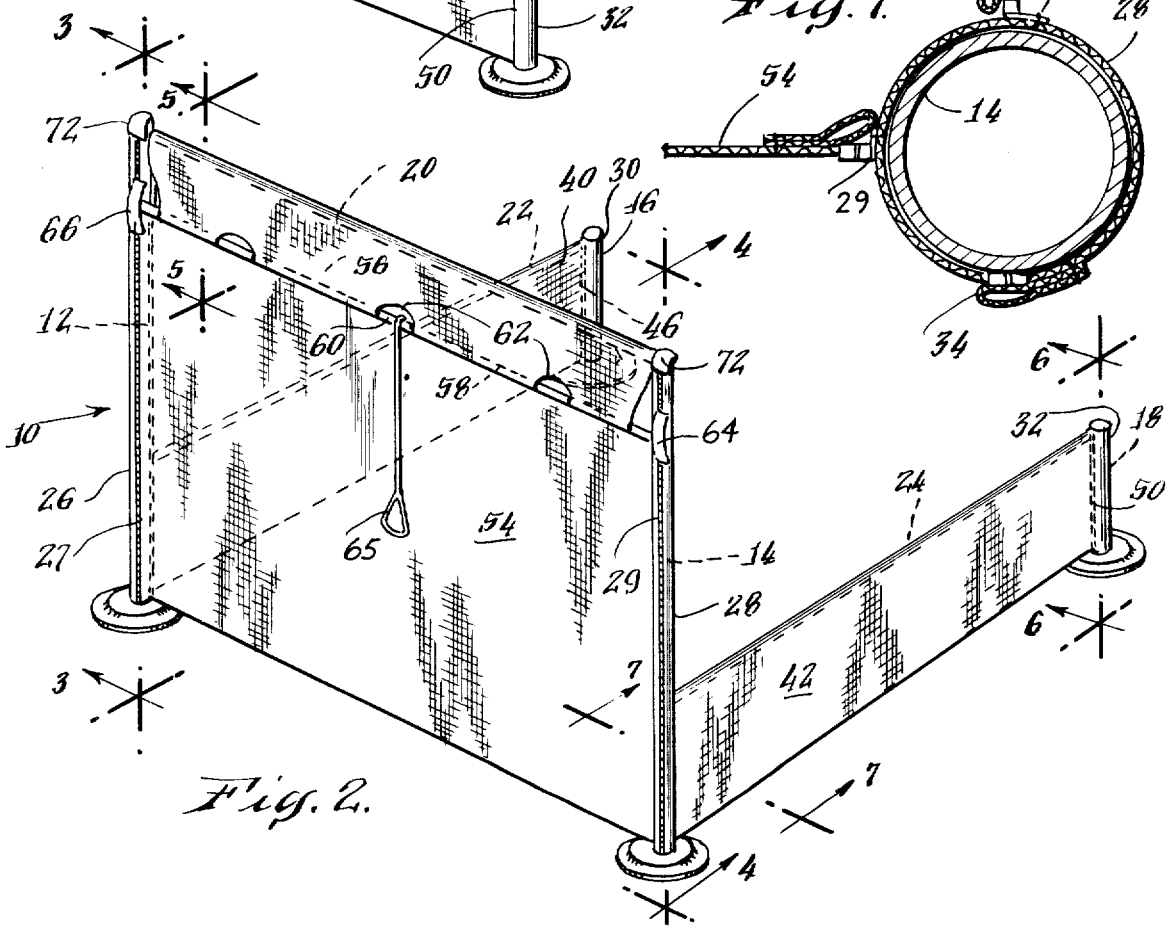
FIG. 2 is another perspective view showing the unit of FIG. 1, but from the rear thereof.
Figure 3:
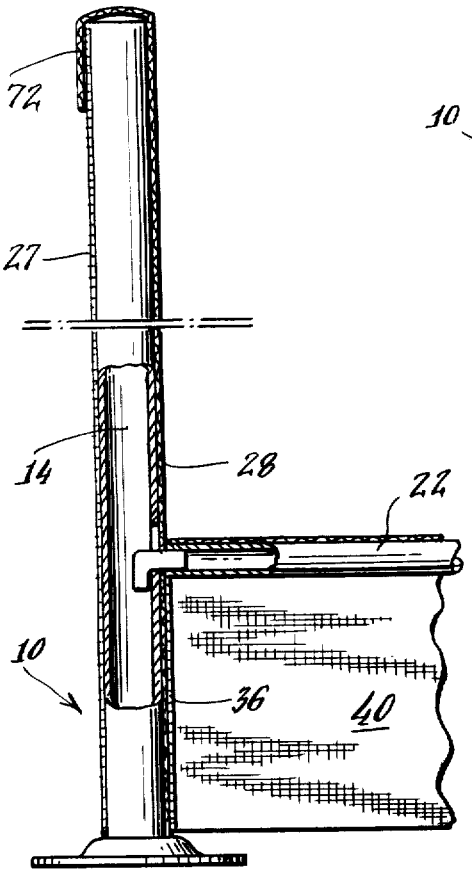
FIG. 3 is a partial sectional view of the unit taken along the lines 3—3 of FIG. 2.
Figure 4:
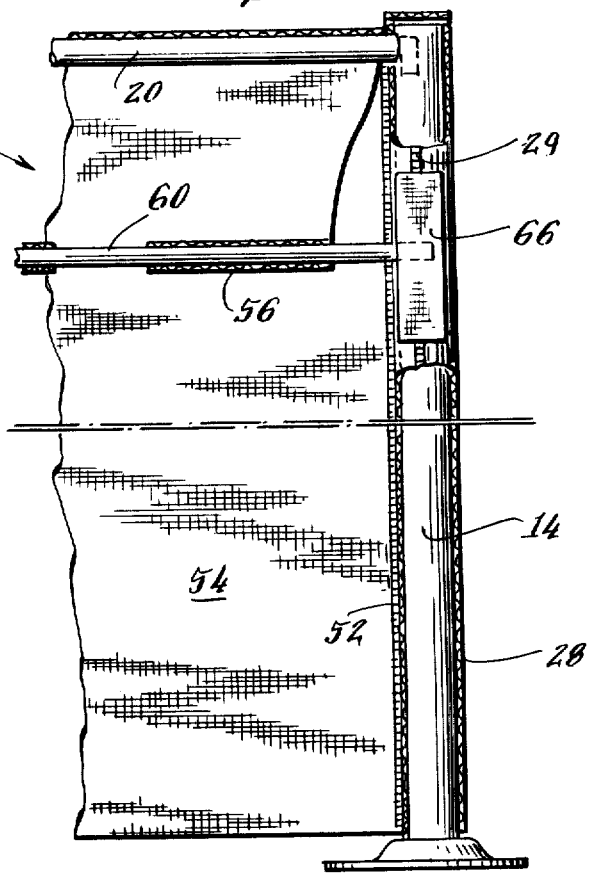
FIG. 4 is another partial sectional view of the display unit along the lines 4—4 of FIG. 2.

The side posts 16 and 18 are connected to upright standards 12 and 14, respectively by side rails 22 and 24, as seen in FIGS. 1 and 2. Side rail sheets 40 and 42 are attached to side rails 22 and 24, respectively. One side edge is provided with a zipper 44 which is attached to a closure element 46 on the short sleeve 30 inserted over side post 16, while the side edge of side rail sheet 42 is provided with a zipper 48 attached to closure element 50 on the short sleeve 32 inserted over side post 18. As mentioned hereinbefore, the zipper 36 is a short closure device on slidable sleeves 26 and 28 which coacts with complementary zipper devices on each of the side edges of the side rail sheets 40 and 42, respectively adjacent to said vertical standards 12 and 14.

Figure 5:
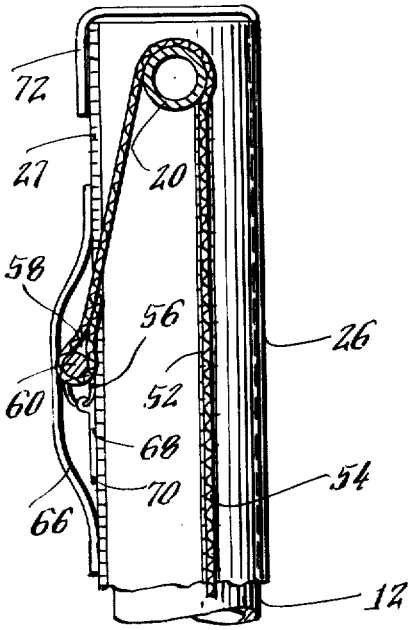
FIG. 5 is an enlarged sectional view taken along thelines 5—5 of FIG. 2.
Figure 6:
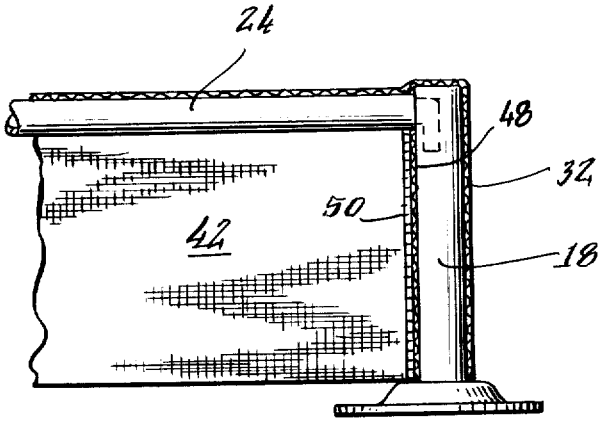
FIG. 6 is a partial sectional view of the side rail posts taken along the lines 6—6 of FIG. 2.

With the exhibition booth partly assembled as described hereinbefore, the upper part of the main sheet 54 is passed over the rail 20 so that the free end of said sheet rests on the rear side of said sheet, as clearly seen in FIGS. 1, 2, 4 and 5. The marginal edge 56 of the sheet 54 is provided with an elongated looped pocket or sleeve 58 through which an expandable pole 60 is located. Also provided in the marginal edge 56 are hand hold openings 62. Finally, a pull strap 65 is attached to the expandable pole 60 and extends vertically behind the main sheet 54. As seen in FIG. 5, the horizontal and expandable pole 60 is slid through the sleeve 58 until the ends thereof enter pockets 64 and 66 which are affixed to the slidable sleeves 26 and 28, respectively. When the pole 60 is in the required position, it is held in the expanded condition by means of a locking arrangement (not shown). Furthermore, the sleeve 58 is provided with a pressure-engaging, separable tab 68 which is adapted to be affixed to a pressure-engaging fabric strip 70 on the corresponding slidable sleeve. The tab 68 and strip 70 may take the form of separable fastener means, such as fasteners manufactured under the registered trademark VELCRO. The same arrangement occurs with respect to corresponding slidable sleeve 28. In this manner, the main sheet 54 is held in both horizontal and vertical tension, thereby providing a taut backdrop for an exhibition booth, which additionally has sufficient strength to support other objects, such as lighting units, shelving and header arrangements. The main sheet 54 is affixed on its side marginal edges to adjacent sleeves 26 and 28 on upright standards 12 and 14, respectively. The zipper closure devices 27 and 29 connect the sleeves to the main sheet. Thus, when all the closure zippers are in their closed position the main rear sheet 54 is attached to the vertical standards 12 and 14, while the side rail sheets are attached to the side posts 16 and 18, as well as the vertical standards 12 and 14 to form a three-sided exhibition booth. Although a three-sided booth is shown it should be evident that other types of configurations can be assembled within the teachings of the present invention.

A series of additional pressure-engaging, separable strips may be utilized in the present arrangement, for example, separable fastening strips 72 may be used as cover flaps for the tops of vertical standards 12 and 14.

In order to install applicant's fabric display unit functioning as a hanging fabric exhibition booth delineator, the following procedure is followed: The side rails 22 and 24 are removed from the respective vertical standards 12 and 14. The sleeves of the side rail sheets 40 and 42 are slid over the respective side rail rods whereby the side rail sheets 40 and 42 hang downwardly. The zippers 36 on the slidable sleeves 26 and 28 that are slipped over the upright vertical standards 12 and 14 are zipped to the closure elements 52 on the side rail sheets 40 and 42, respectively. The Velcro mast cover flaps 72 are pulled over the top of the mast and pressed into place on the back of the sleeves 24 and 26. The expandable locking pole 60 is slid through the sleeve or pocket 58. The pull strap 65 is thrown over the top rail from the front of the booth and the same is pulled down in the rear thereof. Thereafter, the Velcro straps 68 are temporarily pressed into position in respective pockets 64 and 66. Next the main rear sheet 54 is attached to the sleeves 26 and 28 by means of complementary zipper devices 27 and 29. Thereafter, the locking pole 60 is expanded into the lock pockets 64 and 66 to provide horizontal tension. Finally, pole 60 is pulled downwardly to provide vertical tension. When the pole is under tension in the respective pockets 64 and 66, the Velcro tabs 68 can be affixed finally on complementary pressure-engaging strips 70.

Although one embodiment of the present invention has been disclosed and described, it will thus be apparent that variations and modifications may be made therein without departing from the spirit and scope of the invention as defined in the following claims.

What is claimed is:

1. A portable fabric display booth assembly for at least partially enclosing an area defined by a pair of spaced posts and a pair of spaced standards having side and back railings respectively comprising: each of said posts and standards being provided with a sleeve having a first closure member for closing and opening said sleeve and a second closure member, a pair of flat fabric pieces each having closure members on opposite ends thereof which are adapted to be supported by respective side railings and to be interconnected with respective closure members on said respective post and standard to form side fabric panels, a main flat rear fabric piece supported by the back railing and having closure members at opposite ends thereof for interconnecting with the closure members on the sleeves on said spaced standards to form the back fabric panel of said display booth, a marginal top edge of said main flat rear fabric piece having an elongated sleeve coextensive therewith, an expandable pole in said elongated sleeve, and pockets located on the rear of each sleeve on said standards to hold the ends of said pole when said top of said flat fabric piece is drawn over the back railing to thereby hold said main piece in a taut condition.

2. The assembly as claimed in claim 1 wherein said closure members are zippers.

3. The assembly as claimed in claim 1 further comprising fabric strips and corresponding pressure-engaging fabric tabs for holding the ends of said expandable pole in the respective pockets.

4. The assembly as claimed in claim 1 further comprising a plurality of spaced hand-holds in said marginal edge of the main flat rear fabric piece.

5. The assembly as claimed in claim 4 further comprising a pull strap located in one of said hand-holds and being secured to said expandable pole.

* * * * *